US007840161B2

(12) United States Patent
Namisaki et al.

(10) Patent No.: US 7,840,161 B2
(45) Date of Patent: Nov. 23, 2010

(54) FUSING DEVICE AND IMAGE FORMING APPARATUS USING THE SAME

(75) Inventors: Kousuke Namisaki, Yamatokoriyama (JP); Yoshinobu Tateishi, Shiki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 19 days.

(21) Appl. No.: 12/364,550

(22) Filed: Feb. 3, 2009

(65) Prior Publication Data

US 2009/0208266 A1 Aug. 20, 2009

(30) Foreign Application Priority Data

Feb. 14, 2008 (JP) ..... 2008-032575

(51) Int. Cl.
*G03G 15/16* (2006.01)

(52) U.S. Cl. ..... 399/122; 399/328

(58) Field of Classification Search ..... 399/67, 399/107, 110, 122, 320, 328, 330, 331; 219/216
See application file for complete search history.

(56) References Cited

U.S. PATENT DOCUMENTS 6,549,740 B2 * 4/2003 Yoneda et al. ..... 399/122
7,263,311 B2 * 8/2007 Ikeda ..... 399/122
7,643,785 B2 * 1/2010 Matsubara et al. ..... 399/329
2007/0110487 A1 5/2007 Kim et al.
2007/0217805 A1 9/2007 Inoue et al.

FOREIGN PATENT DOCUMENTS

| | | | |
|---|---|---|---|
| CN | 1967410 | | 11/2006 |
| JP | 8-22214 | A | 1/1996 |
| JP | 2001-183938 | A | 7/2001 |
| JP | 2003-43842 | A | 2/2003 |
| JP | 2003-140482 | | 5/2003 |
| JP | 2006-011104 | | 1/2006 |
| JP | 2007-024950 | | 2/2007 |
| JP | 2007-248654 | A | 9/2007 |

* cited by examiner

*Primary Examiner*—Hoan Tran
(74) *Attorney, Agent, or Firm*—Nixon & Vanderhye, PC

(57) ABSTRACT

A fusing unit for an image forming apparatus includes a fusing roller and a pressing roller, each having an elastic layer on their outer peripheral surfaces. A pressing structure presses the fusing roller against the pressing roller. When a sheet of paper with an unfixed toner image passes through a nip portion where the fusing roller and pressing roller are in press-contact with each other, the toner image is fused and fixed to the paper. The fusing unit further includes a pressure release lever for regulating the pressing action of the pressing structure when the rollers are put in press-contact with each other.

13 Claims, 10 Drawing Sheets

FUSING DEVICE AND IMAGE FORMING APPARATUS USING THE SAME

This Nonprovisional application claims priority under 35 U.S.C. §119 (a) on Patent Application No. 2008-032575 filed in Japan on 14 Feb. 2008, the entire contents of which are hereby incorporated by reference.

BACKGROUND OF THE TECHNOLOGY (1) Field of the Technology

The technology relates to a fusing device and an image forming apparatus using the fusing device, and in particular relates to a fusing device that includes a pair of roller elements functioning as a fusing roller and a pressing roller to pass a recording medium with an unfixed toner image formed thereon to the contact nip where these roller elements are put in contact with each other, to thereby fix the toner image formed on the recording thereto, as well as relating to an image forming apparatus using this fusing device.

(2) Description of the Prior Art

Conventionally, in image forming apparatus using electrophotography, such as facsimile machines, printers, etc., an image is output on a recording medium by charging a rotationally driven photoreceptor drum by a charger, forming an electrostatic latent image on the photoreceptor drum by irradiation with light in accordance with image information, applying toner (dry type toner) to this electrostatic latent image from a developing unit to form a toner image, then transferring the toner image to a sheet material, paper or other recording media.

This image forming apparatus includes a fusing device that fuses and fixes the unfixed toner on the recording medium being conveyed. This fusing device, in most cases, is a thermal fusing roller type which is comprised of a pair of roller members, i.e., a fusing roller (heat roller) including a fusing source (heat generator) such as a halogen lamp or the like and a pressing roller, arranged opposing each other at the position where the unfixed toner is fused and fixed. In this arrangement, the recording medium with an unfixed toner image thereon is passed through the press-contact area (fusing nip portion) where the two roller members press each other at a predetermined pressure, whereby the toner image on the recording medium is fixed to the recording medium (see patent document 1: Japanese Patent Application Laid-open No. 2007-248654).

However, the above conventional fusing device suffers the problem that pressing the roller members against each other for many hours by use of a pressing member such as a spring etc., causes partial permanent deformation in the elastic layer formed on the outer periphery of the roller member.

As the measures against this problem, a prior art technique has been disclosed in which a fusing device includes a fusing roller having a thermal conductive member (metal core) that transfers heat from a heat generator to the recording medium by thermal conduction and a pressing roller that has an elastic layer forming a nip portion with the fusing roller to convey the recording medium by nipping it, and is constructed such that while the distance from the thermal conductive member to the axis of the pressing roller is made constant regardless of whether the fusing device is activated or deactivated, the nip width during the fusing device being in operation is created by thermal expansion of the pressing roller, to thereby prevent partial deformation in the elastic layer of the pressing roller, which would arise when a spring or any other pressing element is used to impart a pressing force (see patent document 2: Japanese Patent Application Laid-open Hei 8 No. 22214).

However, in this prior art, the nip portion is created by causing the roller member to thermally expand without use of any pressing element such as a spring or the like, it is hence impossible to keep the pressing force and the nip width constant at any time. As a result there has been the problem that the fusing operation is unstable.

SUMMARY OF THE TECHNOLOGY

The technology has been devised in view of the above conventional problem, therefore an object is to provide a fusing device and an image forming apparatus using this fusing device which can realize stable fusing operation by preventing partial permanent deformation of roller members in the fusing device.

The fusing device and image forming apparatus including this fusing device for solving the above problems are constructed as follows.

In accordance with the first aspect, a fusing device including a pair of roller members functioning as a fusing roller and a pressing roller, at least one of the roller members having an elastic layer on the peripheral surface thereof, and a pressing structure for bringing the roller members into press-contact with each other, for causing a recording medium with an unfixed toner image formed thereon to pass through the press-contact portion where the roller members are put in press-contact with each other to thereby fuse the toner image and fix it to the recording medium, comprises: a pressing structure regulator for regulating the pressing action of the pressing structure when the roller members are put into contact with each other by the pressing structure.

In accordance with the second aspect, it is preferred that the aforementioned pressing structure regulator is constituted by part of a frame structure of the fusing device for supporting one of the paired roller members, and regulates the pressing action of the pressing structure when the pressing structure is abutted to the part of the frame structure.

The frame structure of the fusing device for holding a pair of roller members, when for instance, the paired roller members are arranged at the top and the bottom, may be composed of an upper frame for holding the upper roller and a lower frame for holding the lower roller. In this case, the pressing structure may be abutted against part of the upper frame or the lower frame so as to limit the pressing action of the pressing structure.

In accordance with the third aspect, it is preferred that the aforementioned pressing structure regulator includes a pressure release member for releasing the press-contact state between the rollers by the pressing structure and a pressure release member regulator for regulating the movement of the pressure release member, and the pressing action of the pressing structure is regulated by putting the pressure release member and the pressure release member regulator into contact with each other under the condition where the pressing structure and the pressure release member are in contact when the roller members are put into contact with each other by the pressing structure.

In accordance with the fourth aspect, it is preferred that with the roller members put in press-contact with each other by the pressing structure, the pressing structure regulator is adapted to create a necessary nip width for fusing toner images, by thermal expansion of the roller members when a fusing operation for fusing and fixing toner images to recording mediums is activated.

In accordance with the fifth aspect, an image forming apparatus may include one of the fusing devices described in the above first to fourth aspects.

According to the first aspect, since no pressing force greater than needed will be applied between the roller members, it is possible to prevent occurrence of partial permanent deformation in the elastic layers of the roller members, hence achieve a stable fusing operation.

According to the second aspect, since no pressing force greater than needed will be applied between the roller members without the necessity of providing a separate regulator and the like for regulating the press-contact state of the roller members, it is possible with a simple structure to prevent occurrence of partial permanent deformation in the elastic layers of the roller members.

According to the third aspect, since no pressing force greater than needed will be applied between the roller members, it is possible to prevent occurrence of partial permanent deformation in the elastic layers of the roller members.

According to the fourth aspect, it is possible to assure the nip width necessary for fusing by thermal expansion of the roller members when a fusing operation is performed by the paired roller members.

According to the fifth aspect, since a stable fusing operation can be carried out by preventing occurrence of partial permanent deformation in the elastic layers of the roller members, it is possible to provide an image forming apparatus which can stably achieve high-quality image printing with toner images reliably fused and fixed.

DESCRIPTION OF THE PREFERRED EMBODIMENTS

The embodiments will hereinafter be described in detail with reference to the accompanying drawings.

Figure 1:
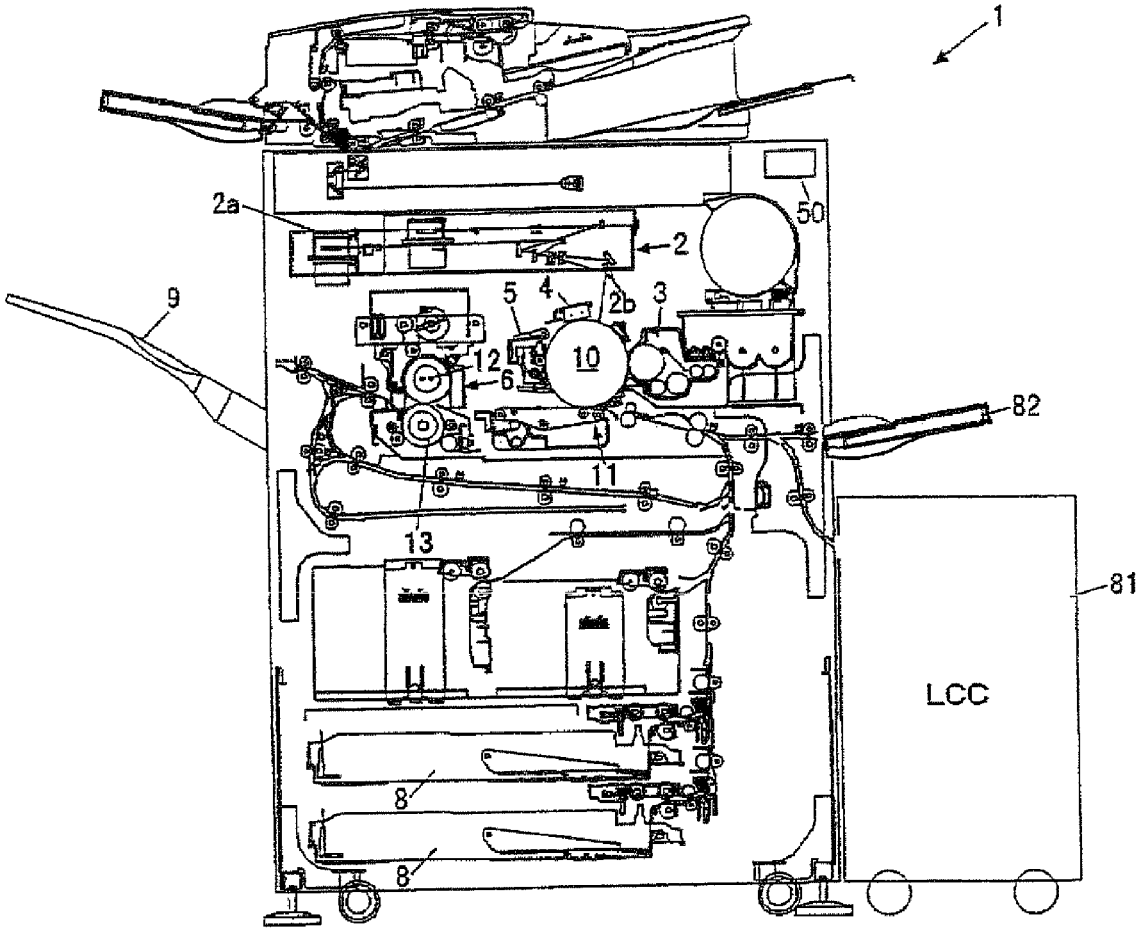
FIG. 1 is an illustrative view showing an overall configuration of an image forming apparatus which uses a fusing unit.

FIG. 1 is an illustrative view showing an overall configuration of an image forming apparatus which uses a fusing unit.

As shown in FIG. 1, an image forming apparatus 1 according to the present embodiment includes a fusing unit (fusing device) 6 which is comprised of a pair of roller members, a fusing roller 12 and a pressing roller 13, having an elastic layer on their outer peripheral surface, forming a press-contact portion or so-called nip portion where fusing roller 12 and pressing roller 13 are put in contact, and allows a sheet of paper (recording medium) with an unfixed toner image formed thereon to pass through the nip portion so as to fuse the toner image and fix it to the paper. In this image forming apparatus, the fusing device is used as fusing unit 6.

To begin with, the overall configuration of image forming apparatus 1 according to the present embodiment will be described.

As shown in FIG. 1, image forming apparatus 1 forms a monochrome image on a predetermined sheet (recording paper) in accordance with image data transmitted from without or image data captured by image forming apparatus 1 itself, and includes an exposure unit 2, a developing unit 3, a photoreceptor drum 10, a transfer unit 11, a charger 4, a cleaning unit 5, a fusing unit 6, a paper feed tray 8, a paper output tray 9 and a controller 50.

Charger 4 is a charging device for uniformly electrifying the photoreceptor drum 10 surface at a predetermined potential. Charger 4 may employ a non-contact type or corona discharge type charger 4 shown in FIG. 1 or may use a contact type charger such as a roller type or a brush type.

Exposure unit 2 irradiates photoreceptor drum 10 that has been uniformly charged by charger 4, in accordance with the aforementioned image data so as to form an electrostatic latent image corresponding to the image data on the photoreceptor drum 10 surface.

As exposure unit 2, as shown in FIG. 1 a laser scanning unit (LSU) including a laser emitter 2*a* and a reflection mirror 2*b* may be used. Alternatively, a writing head with an array of light emitting elements (EL or LEDs), for example may be used. Here, in image forming apparatus 1 of the present embodiment, in order to achieve high-speed printing operation, a two-beam method, which alleviates the rush of irradiation timings by using a multiple number of laser beams, is adopted.

Developing unit 3 visualizes the electrostatic latent image formed on the photoreceptor drum 10 surface with toner, black toner herein, to form a toner image.

Transfer unit 11 transfers the toner image developed on photoreceptor drum 10 by developing unit 3 to a sheet of paper that is being conveyed.

Fusing unit 6 causes the paper with an unfixed toner image transferred thereon by transfer unit 11 to pass through the press-contact portion (which will be referred to hereinbelow as "fusing nip portion") between rotatable fusing roller (roller member) 12 and pressing roller (roller member) 13 that is put in press-contact with the fusing roller 12 so as to fuse the toner image on the paper and fix it to the paper. Details of fusing unit 6 will be described later.

Cleaning unit 5 removes and collects the toner remaining on the photoreceptor drum 10 surface after development and image transfer.

Paper feed tray 8 is a tray for stacking sheets of paper to be used for image forming. Since, in the present embodiment, in order to deal with a large volume of high-speed printing processing, a multiple number of paper feed trays 8, 8 each capable of stacking 500 to 1500 sheets of standard-sized paper are arranged under image forming apparatus 1. Further, a large-capacity paper feed cassette (LCC) 81 capable of storing multiple kinds of paper in large volumes and a manual feed tray 82 for mainly supporting printing for irregular sized paper are arranged at the side of image forming apparatus 1.

Paper output tray 9 stacks the paper processed through image forming. This paper output tray 9 is arranged on the opposite side across image forming apparatus 1 from that of manual feed tray 82. It is also possible to configure such a system that instead of paper output tray 9, a post-processing machine for stapling, punching and performing other processes of, the sheets of paper after image forming, and/or a multi-bin paper output tray may be arranged as an option.

Controller 50 performs operational controls of the aforementioned individual components and also performs image processing of image data. Controller 50 is a micro computer including, at least, a CPU and RAM, and functions to operate based on the programs recorded on an unillustrated recording medium.

Next, fusing unit 6 that characterizes the present embodiment will be described in detail with reference to the drawings.

Figure 2:
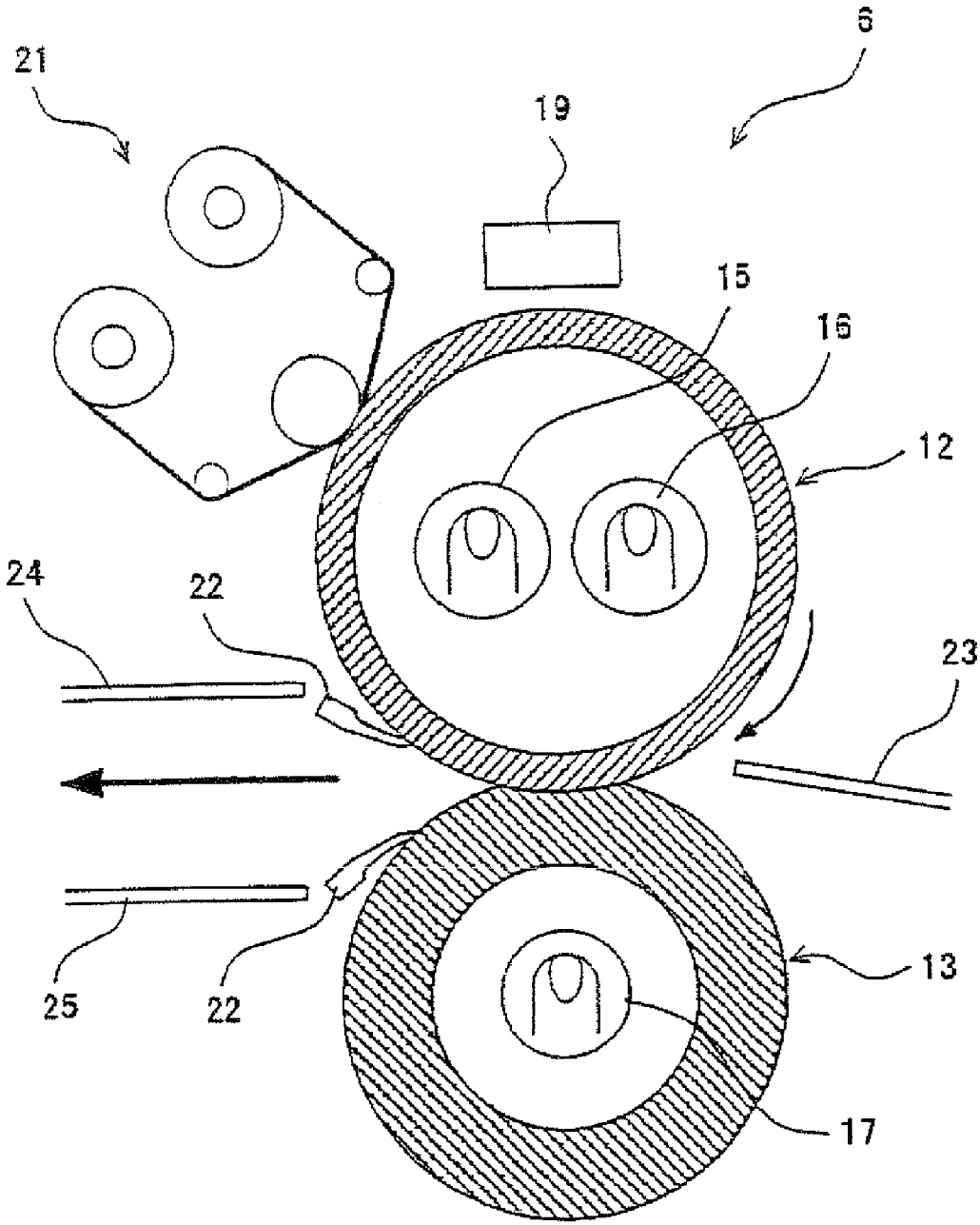
FIG. 2 is an illustrative view showing a schematic configuration of the fusing unit.
Figure 3:
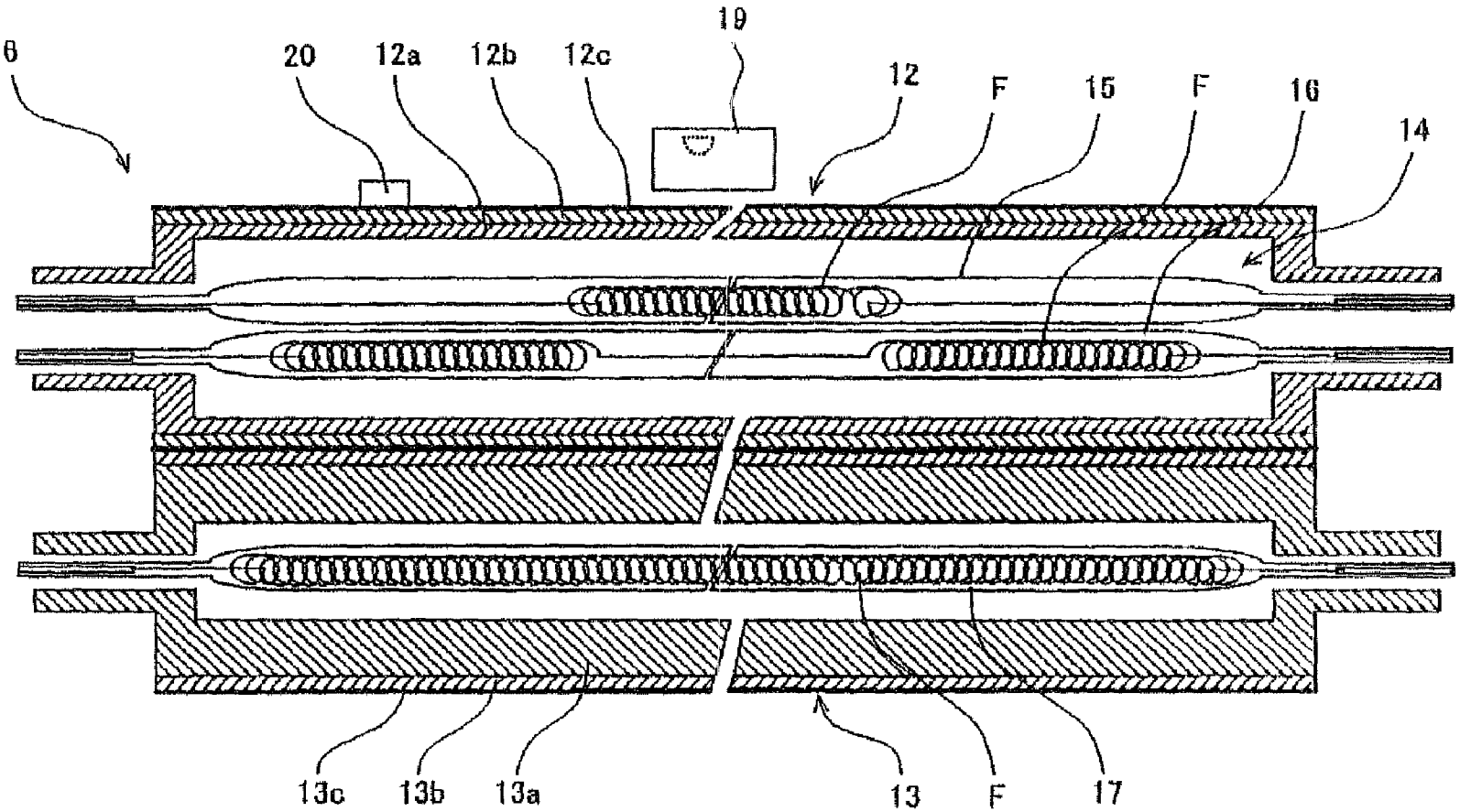
FIG. 3 is a sectional side view showing the configuration of the fusing unit.

FIG. 2 is an illustrative view showing a schematic configuration of the fusing unit according to the present embodiment. FIG. 3 is a sectional side view showing the fusing unit configuration.

As shown in FIGS. 2 and 3, fusing unit 6 is composed of fusing roller 12 and pressing roller 13 arranged opposing each other so that pressing roller 13 is put into press-contact with fusing roller 12.

Fusing roller 12 is heated at a predetermined temperature to apply heat to the paper with a toner image (unfixed) formed thereon that passes through the fussing nip portion. This fusing roller 12 has, as shown in FIG. 3, a cylindrical body formed of a prime pipe 12*a* made of metal such as iron, stainless steel, aluminum, copper, etc., alloy of these or the like, and silicone rubber (of 1 to 3 mm thick) covered on the pipe as an elastic layer 12*b*.

Elastic layer 12*b* of silicone rubber has a heat storage function. Formed on this elastic layer 12*b* is a releasing layer 12*c* made of fluororesin such as PFA (copolymer of tetrafluoroethylene-perfluoroalkyl vinyl ether), PTFE (polytetrafluoroethylene) or the like.

Fusing roller 12 also includes a heating device (heat source) 14 in the hollow of the cylindrical body for setting the fusing roller 12 surface at a temperature required for fusing the toner image. The surface of fusing roller 12 is heated by this heating device 14 to a predetermined set temperature for fusing. The set temperature for fusing is typically 160 to 200 deg. C., and is set at 180 deg. C. in the present embodiment.

Heating device 14 includes two heat sources, a main heater (center heat source or main heat source) 15 and a sub heater (side heat source or sub heat source) 16 so that they can heat the fusing roller 12 surface separately in the center portion and in the side portions, respectively. Main heater 15 is formed of a coiled filament F arranged in the central area of fusing roller 12. This coil of filament F forms a heat-generating portion so as to heat the center area of fusing roller 12. On the other hand, sub heater 16 has a pair of coils of filament F located at both side ends outside the heat-generating portion of main heater 15. These portions where coils of filament F are located form heat generating areas so as to heat both side parts of fusing roller 12.

Arranged at the center and at one side of fusing roller 12 are temperature sensors 19 and 20, which comprise thermistors for detecting the temperature on the fusing roller 12 surface. These temperature sensors 19 and 20 constitute the temperature detecting means for detecting the surface temperature of the portions corresponding to the heat generating areas of main heater 15 and sub heater 16 that can separately heat the fusing roller 12 surface.

Temperature sensor 19 is the centered temperature sensor for detecting the temperature of the center area of fusing roller 12 and is arranged out of contact with the fusing roller 12 surface. On the other hand, temperature sensor 20 is the side area temperature sensor for detecting the temperature at the side area of fusing roller 12 and is arranged in contact with fusing roller 12.

In the present embodiment, since the paper passes through the central part of fusing roller 12 more frequently than the side areas, centered temperature sensor 19 is more likely to be damaged by the paper that sticks to the fusing roller 12 surface. This is why temperature sensor 19 is kept out of contact with the roller surface.

Further, in the present embodiment, the temperature controller (not shown) included in controller 50 is adapted to calibrate the temperature detected by centered temperature sensor 19 for the temperature discrepancy resulting from the gap distance from the fusing roller 12 surface.

On the other hand, pressing roller 13 has a cylindrical body formed of a prime pipe 13*a* made of metal such as iron, stainless steel, aluminum, copper, etc., alloy of these or the like, and silicone rubber (of 1 to 5 mm thick) covered on the pipe as an elastic layer 13*b*. Similarly to fusing roller 12, elastic layer 13*b* of silicone rubber has the heat storage function. Formed on this elastic layer 13*b* is a releasing layer 13*c* made of fluororesin such as PFA (copolymer of tetrafluoroethylene-perfluoroalkyl vinyl ether), PTFE (polytetrafluoroethylene) or the like.

Further, in the present embodiment, pressing roller 13 also incorporates a heating means (heat source) or heater (which will be referred to hereinbelow as pressing side heater) 17 so as to suppress pressing roller 13 from taking heat from fusing roller 12.

Pressing side heater 17 has a coil of filament F that extends along the axis of pressing roller 13 so as to oppose the approximately full length of fusing roller 12. This coil of filament F constitutes a heat generating part, or heats pressing roller 13 as a whole across the approximately full length of it.

Each of the thus constructed fusing roller 12 and pressing roller 13 has paper separation claws 22, 22 for peeling the paper that sticks to the outer periphery of fusing roller 12 or pressing roller 13, as shown in FIG. 2. A cleaning unit 21 for removing toner adhering to the fusing roller 12 surface is provided on the outer periphery of fusing roller 12.

As shown in FIGS. 1 and 2, the paper guided from transfer unit 11 to fusing unit 6 along a paper guide 23 passes through the fusing nip portion between fusing roller 12 and pressing roller 13, then the paper is peeled from fusing roller 12 or pressing roller 13 by paper separation claws 22, 22 and conveyed and guided along paper guides 24 and 25. The surface of fusing roller 12 after the paper is peeled off is cleaned by cleaning unit 21.

Additionally, in fusing unit 6, fusing roller 12 is coupled to a drive source and rotationally driven thereby while pressing roller 13 is arranged with its roller surface put in contact with the fusing roller 12 surface so that it can be driven by rotation of fusing roller 12.

Now, characteristic examples of fusing unit 6 according to the present embodiment will be described with reference to the drawings.

The First Exemplary Embodiment

Firstly, the first exemplary embodiment will be described with reference to the drawings.

Figure 4:
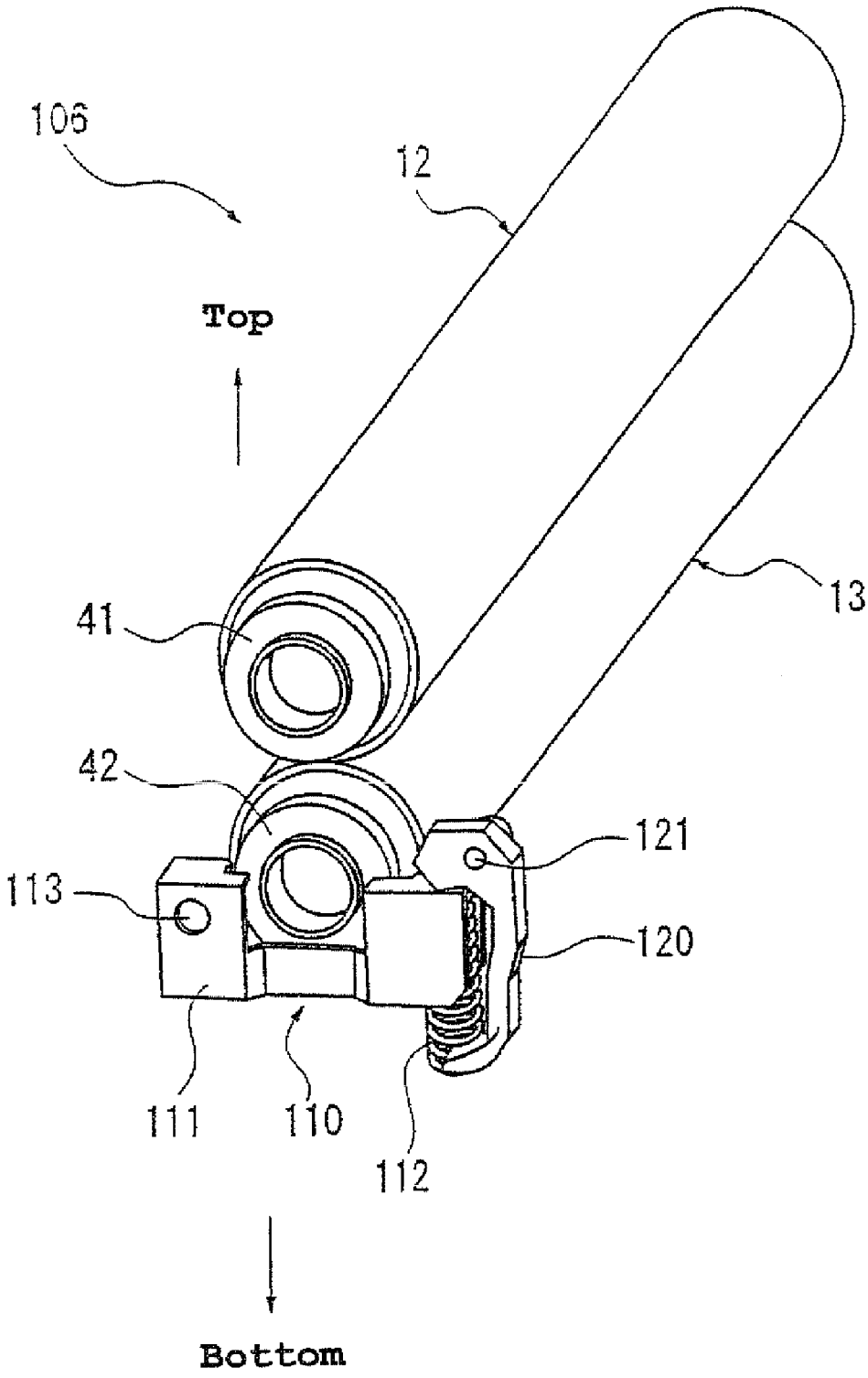
FIG. 4 is a perspective view showing the configuration of a first exemplary embodiment of a fusing unit according to the present embodiment.
Figure 5:
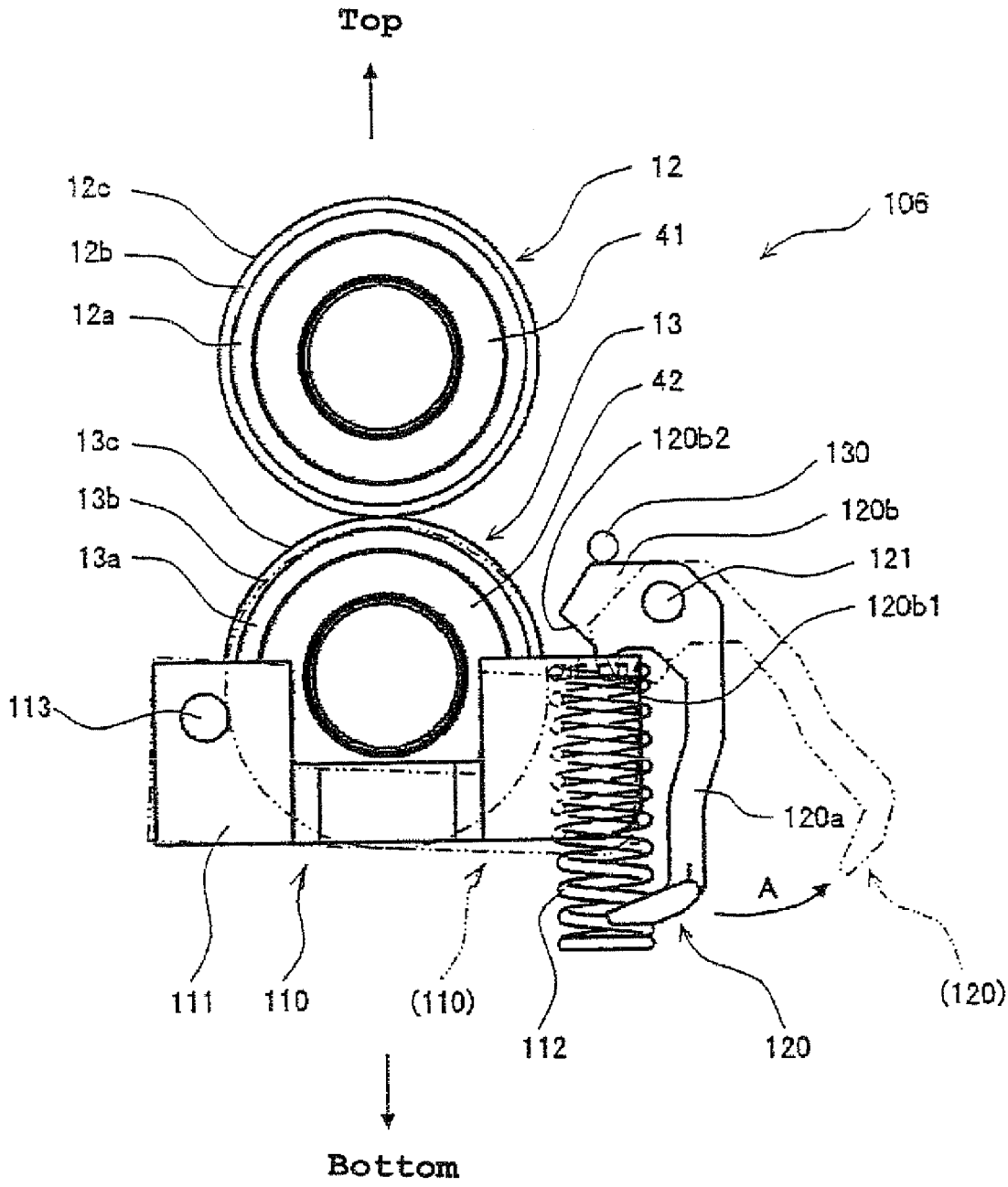
FIG. 5 is an illustrative view showing the configuration of a fusing unit of the first exemplary embodiment, viewed from the direction of the roller axis.

FIG. 4 is a perspective view showing the configuration of the first exemplary embodiment of a fusing unit of the image forming apparatus according to the present embodiment. FIG. 5 is an illustrative view showing the configuration of the fusing unit, viewed from the direction of the roller axis.

As shown in FIGS. 4 and 5, a fusing unit (fusing device) 106 of the first exemplary embodiment includes a pressing structure 110 for arranging rotatable fusing roller 12 and pressing roller 13 so as to oppose each other and put pressing roller 13 into press-contact with fusing roller 12, a pressure release lever (pressure release member) 120 serving as a pressing structure regulator to regulate the pressing action of pressing structure 110 and a pressure release lever positioning pin (pressure release member regulator) 130 for regulating the action of pressure release lever 120.

Fusing roller 12 has a cylindrical body having an outside diameter of 40 mm, comprised of prime tube 12*a*, silicone rubber of 1.5 mm thick formed as elastic layer 12*b* on the outer peripheral side of the prime tube 12*a* and a releasing layer 12*c* of PFA formed with a thickness of 30 μm on the elastic layer 12*b*.

Similarly, pressing roller 13 has a cylindrical body having an outside diameter of 40 mm, comprised of prime tube 13*a*, silicone rubber of 1.5 mm thick formed as elastic layer 13*b* on the outer peripheral side of the prime tube 13*a* and a releasing layer 13*c* of PFA formed with a thickness of 30 μm on the elastic layer 13*b*.

Fusing roller 12 and pressing roller 13 have bearings 41 and 42 for rotatably supporting the respective rollers, inserted at both ends thereof. That is, fusing roller 12 and pressing roller 13 are rotatably attached to the upper unit (not shown) on the fusing roller 12 side and the lower unit (not shown) on the pressing roller 13 side, respectively by means of these bearings 41 and 42.

Pressing structure 110 includes a pressing lever 111 and a pressing spring 112.

Pressing lever 111 supports pressing roller 13 and is pivotably supported at its one side by a supporting shaft 113 so as to be able to press and separate pressing roller 13 with respect to fusing roller 12. Pressing structure 110 has pressing spring 112 arranged on the side opposite from pressing lever 111.

Pressing spring 112 uses a compression coil spring and is arranged so as to cause pressing lever 111 to press pressing roller 13 toward fusing roller 12.

Arranged on the opposite side across pressing structure 110 from pressing lever 111 is pressure release lever 120 for regulating the pressing action of pressing roller 13 by pressing lever 111 and separating pressing roller 13 from fusing roller 12.

Pressure release lever 120 (pressing structure regulator, pressure release member) has a handle portion 120*a* for permitting manual operation and an abutment portion 120*b* that abuts pressing lever 111, and is pivotably supported by a supporting shaft 121 between handle portion 120*a* and abutment portion 120*b*. Abutment portion 120*b* is formed with a pressing lever set position 120*b*1 and a pressing lever release position 120*b*2.

Specifically, as shown in FIG. 5, when pressing lever 111 abuts abutment portion 120*b* at pressing lever set position 120*b*1, pressing roller 13 has been pressed upward by pressing lever 111 under the pressure of pressing spring 112 so as to abut fusing roller 12 at the predetermined position, thus creating the condition in which pressing roller 13 and fusing roller 12 are kept in press-contact with each other by a predetermined pressing force from pressing spring 112 (illustrated by the solid line).

On the other hand, when pressing lever 111 abuts abutment portion 120*b* at pressing lever release position 120*b*2, pressing lever 111 is pushed down so that pressing roller 13 is separated from fusing roller 12 (depicted by the two-dot chain line).

A pressure release lever positioning pin 130 (pressure release member regulator) is attached to part of the unillustrated fusing unit body and is adapted to limit the movement of pressure release lever 120 by abutment of abutment portion 120*b* of pressure release lever 120 against it.

Detailedly, pressure release lever positioning pin 130 is disposed so that when pressing roller 13 is pressed against fusing roller 12 by pressing structure 110, abutment portion 120*b* of pressure release lever 120 abuts the pressure release lever positioning pin 130 while pressing lever 111 abuts pressure release lever 120 at pressing lever set position 120*b*1.

Next, the operation of pressing lever 111 and pressure release lever 120 in fusing unit 106 will be described with reference to the drawings.

Figure 6:
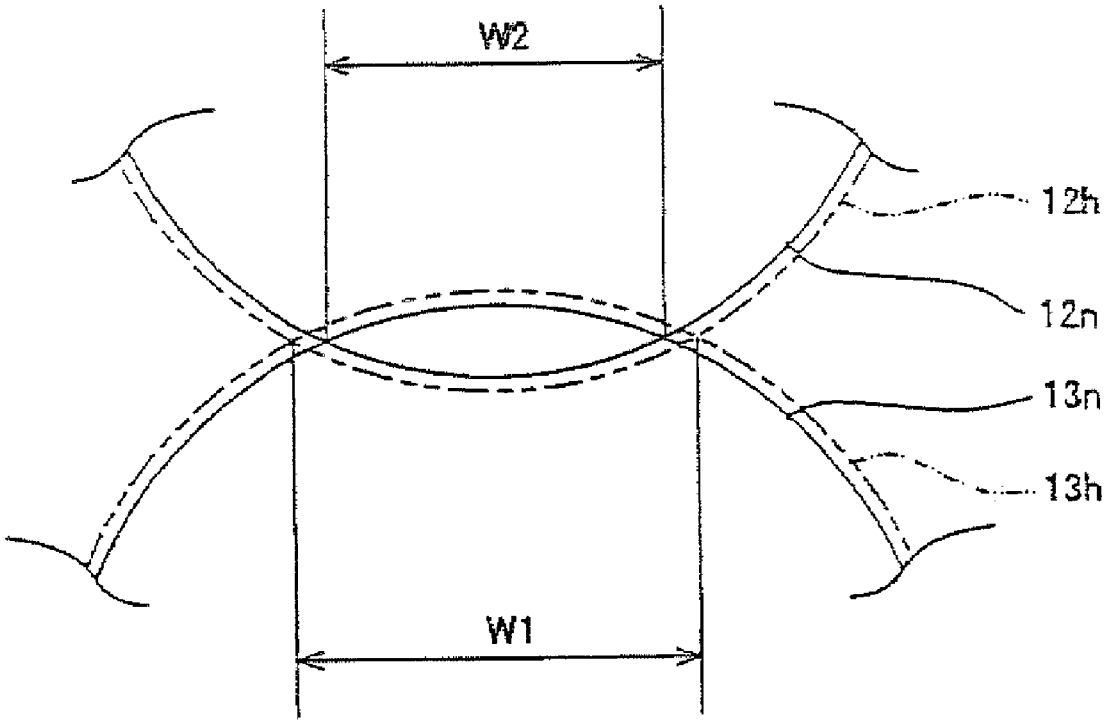
FIG. 6 is an illustrative view showing a state in which a fusing roller and a pressing roller in the fusing unit are pressed against each other.

FIG. 6 is an illustrative view showing a state in which the fusing roller and the pressing roller in the fusing unit according to the present embodiment is pressed against each other.

In fusing unit 106 in its normal state (the state in which the toner image can be transferred), pressing roller 13 is set under a condition that pressing roller 13 is constantly pressed against fusing roller 12 with a predetermined pressing force by pressing lever 111 under the pressure of pressing spring 112, as shown in FIG. 5.

At this time, pressure release lever 120 is positioned with its pressing lever set position 120*b*1 abutted against one end of pressing lever 111 while the top of abutment portion 120*b* abuts pressure release lever positioning pin 130 so that movement of abutment portion 120 upward in the drawing is limited. As a result, pressing lever 111 is retained at pressing lever set position 120*b*1 of abutment portion 120*b* of pressure release lever 120.

Pressing roller 13 supported by pressing lever 111 is placed at the predetermined position relative to fusing roller 12 under the predetermined pressing force from pressing spring 112 (depicted by the solid line) since the pressing action of pressing lever 111 against pressing roller 13 is limited by abutment of pressing lever 111 against abutment portion 120*b* of pressure release lever 120.

On the other hand, in fusing unit 106, when pressing roller 13 is separated from fusing roller 12, handle portion 120*a* of pressure release lever 120 is turned in the direction of arrow A as shown in FIG. 5 so that the position of abutment between abutment portion 120*b* and pressing lever 111 is shifted from pressing lever set position 120*b*1 to pressing lever release position 120*b*2. As a result, pressing lever 111 is pushed downward in the drawing so that pressing roller 13 can be separated from fusing roller 12 (depicted by the two-dot chain line).

With this configuration, even if pressing roller 13 has been urged under pressure against fusing roller 12 for many hours when the apparatus has been set in the ready state or deactivated or the like, it is possible to alleviate the pressing force from pressing spring 112 by bringing pressing lever 111 into contact with pressing lever set position 120*b*1 of abutment portion 120*b* of pressure release lever 120. Accordingly, it is possible to prevent occurrence of partial permanent deformation in elastic layers 12*b* and 13*b* in the area where fusing roller 12 and pressing roller 13 abut each other.

As described above, the movement of pressure release lever 120 is regulated by pressure release lever positioning pin 130, the amount of pressing roller 13 being pressed against fusing roller 12 is limited and the urging force of pressing spring 112 is reduced so that it becomes difficult to assure the nip width necessary for fusing toner images.

To deal with this, in the first exemplary embodiment, in consideration of the thermal expansion of elastic layers 12*b* and 13*b* and releasing layers 12*c* and 13*c*, pressing lever 111 is positioned as shown in FIG. 6 so that the nip width W1 between fusing roller 12 and pressing roller 13, required at the time of toner fusing (fusing temperature: 180 deg. C.) is 4.5 mm and that the nip width W2 between fusing roller 12 and pressing roller 13 at normal temperature (25 deg. C.) is 4.0 mm. With this arrangement, partial permanent deformation in elastic layers 12*b* and 13*b* of fusing roller 12 and pressing roller 13 during the normal state can be prevented from occurring.

The two-dot chain lines designated by reference numerals 12*h* and 13*h* shown in FIG. 6 represent the circumferences of fusing roller 12 and pressing roller 13 at the time of toner fusing while the solid lines designated by reference numerals 12*n* and 13*n* represent the circumferences of fusing roller 12 and pressing roller 13 at normal temperature.

According to the first exemplary embodiment thus constructed, when fusing roller 12 and pressing roller 13 are pressed against each other, the movement of pressure release lever 120 is limited by pressure release lever positioning pin 130 while the pressing action of pressing lever 111 is regulated by pressure release lever 120 so as to retain pressing roller 13 at pressing lever set position 120*b*1. Accordingly, it is possible to prevent a pressing force greater than needed, from being applied on fusing roller 12. As a result, it is possible to prevent occurrence of partial permanent deformation in elastic layers 12*b* and 13*b* of fusing roller 12 and pressing roller 13.

Further, since pressing lever 111 is pushed downward in the drawing by shifting the abutment position between pressure release lever 120 and pressing lever 111, from pressing lever set position 120*b*1 to pressing lever release position 120*b*2, it is possible to separate pressing roller 13 from fusing roller 12.

The Second Exemplary Embodiment

Next, the second exemplary embodiment will be described with reference to the drawings.

Figure 7:
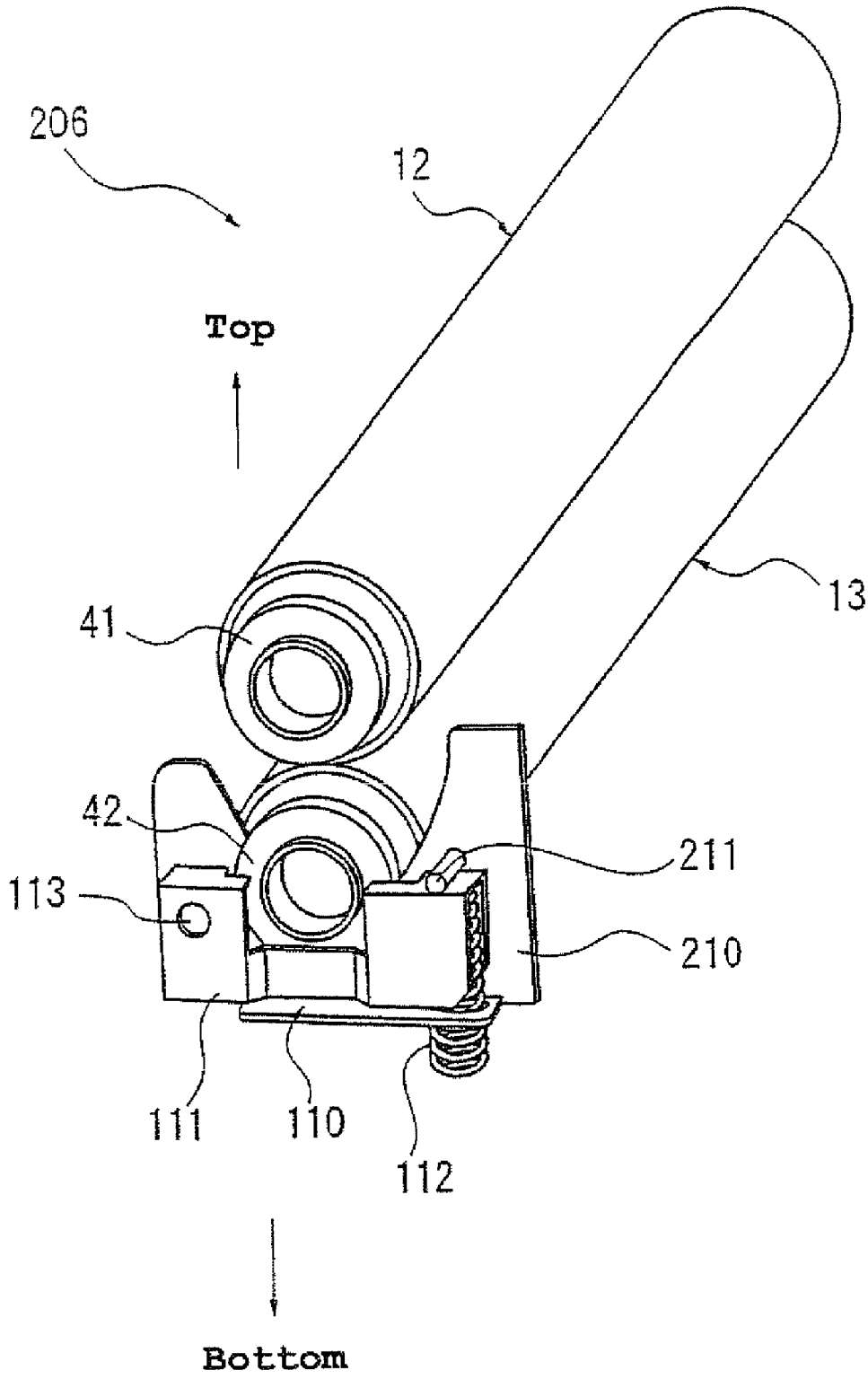
FIG. 7 is a perspective view showing the configuration of a second exemplary embodiment of a fusing unit according to the present embodiment.
Figure 8:
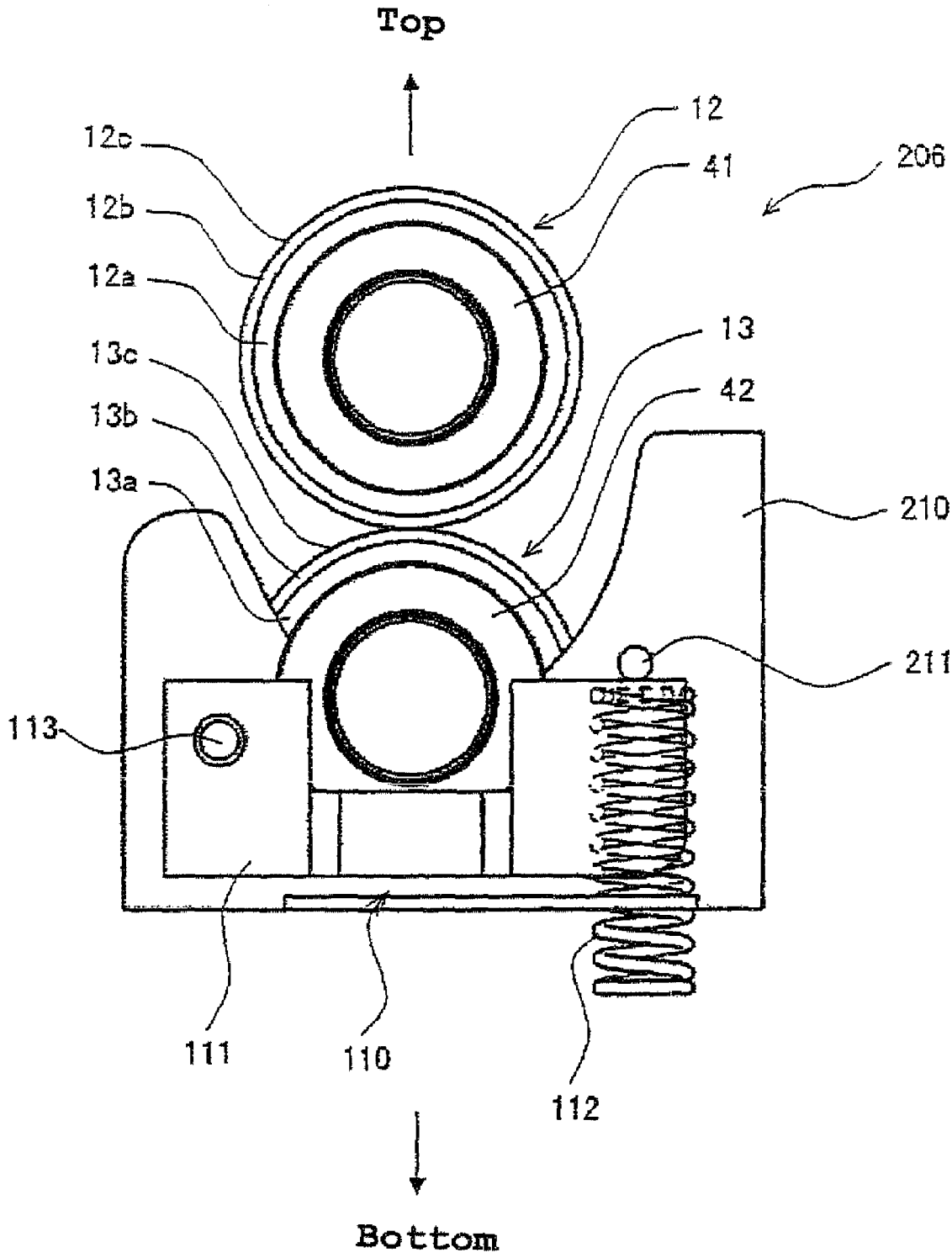
FIG. 8 is an illustrative view showing the configuration of a fusing unit of the second exemplary embodiment, viewed from the direction of the roller axis.

FIG. 7 is a perspective view showing the configuration of the second exemplary embodiment of a fusing unit according to the present embodiment, and FIG. 8 is an illustrative view showing the configuration of the fusing unit of the second exemplary embodiment, viewed from the direction of the roller axis.

Here in the second exemplary embodiment, the same components as those in the first exemplary embodiment are allotted with the same reference numerals, so that their description is omitted.

As shown in FIGS. 7 and 8, a fusing unit (fusing device) 206 of the second exemplary embodiment includes a pressing structure 110 for arranging rotatable fusing roller 12 and pressing roller 13 so as to oppose each other and put pressing roller 13 into press-contact with fusing roller 12 and a pressing roller side frame (frame structure) 210 for regulating the pressing action of pressing structure 110.

Here, in the second exemplary embodiment, the difference from the configuration of the first exemplary embodiment will be described.

Pressing roller side frame 210 has a supporting shaft 113 for pivotably supporting a pressing lever 111 and also has a positioning pin (pressing structure regulator) 211 for regulating the movement of pressing structure 110.

Positioning pin 211 is arranged at a position opposing the opposite end of pressing lever 111 across the shaft of pressing roller 13 from the supporting shaft 113 side so as to prevent pressing lever 111 from urging pressing roller 13 toward fusing roller 12 side when pressing roller 13 is positioned in place with respect to fusing roller 12.

Specifically, as shown in FIG. 8, when pressing lever 111 abuts positioning pin 211, pressing roller 13 has been pressed upward by pressing lever 111 under the pressure of pressing spring 112 so as to abut fusing roller 12 at the predetermined position, thus creating the condition in which pressing roller 13 and fusing roller 12 are kept in press-contact with each other by a predetermined pressing force from pressing spring 112.

With this configuration, even if pressing roller 13 has been urged under pressure against fusing roller 12 for many hours when the apparatus has been set in the ready state, deactivated or the like, it is possible to alleviate the pressing force from pressing spring 112 by abutting pressing lever 111 against positioning pin 211. Accordingly, it is possible to prevent elastic layers 12*b* and 13*b* of fusing roller 12 and pressing roller 13 from being partially deformed permanently.

As described above, since the pressing action of pressing lever 111 is limited by positioning pin 211 so as to regulate the amount of pressing roller 13 being pressed against fusing roller 12 and hence alleviate the urging force from pressing spring 112, it becomes difficult to assure the nip width necessary for fusing toner images. To deal with this, also in the second exemplary embodiment, in consideration of the thermal expansion of elastic layers 12*b* and 13*b* and releasing layers 12*c* and 13*c*, the layout of positioning pin 211 is designated so that the nip width W1 between fusing roller 12 and pressing roller 13, required at the time of toner fusing (fusing temperature: 180 deg. C.) is 4.5 mm and that the nip width W2 between fusing roller 12 and pressing roller 13 at normal temperature (25 deg. C.) is 4.0 mm. With this setup, partial permanent deformation in elastic layers 12*b* and 13*b* of fusing roller 12 and pressing roller 13 in the normal state can be prevented from occurring.

According to the second exemplary embodiment thus constructed, since the pressing action of pressing lever 111 is regulated by positioning pin 211 provided for pressing roller side frame 210, it is possible to prevent a pressing force greater than needed, from being applied on fusing roller 12. As a result, it is possible to prevent occurrence of partial permanent deformation in elastic layers 12*b* and 13*b* of fusing roller 12 and pressing roller 13.

The Third Exemplary Embodiment

Next, the third exemplary embodiment will be described with reference to the drawings.

Figure 9:
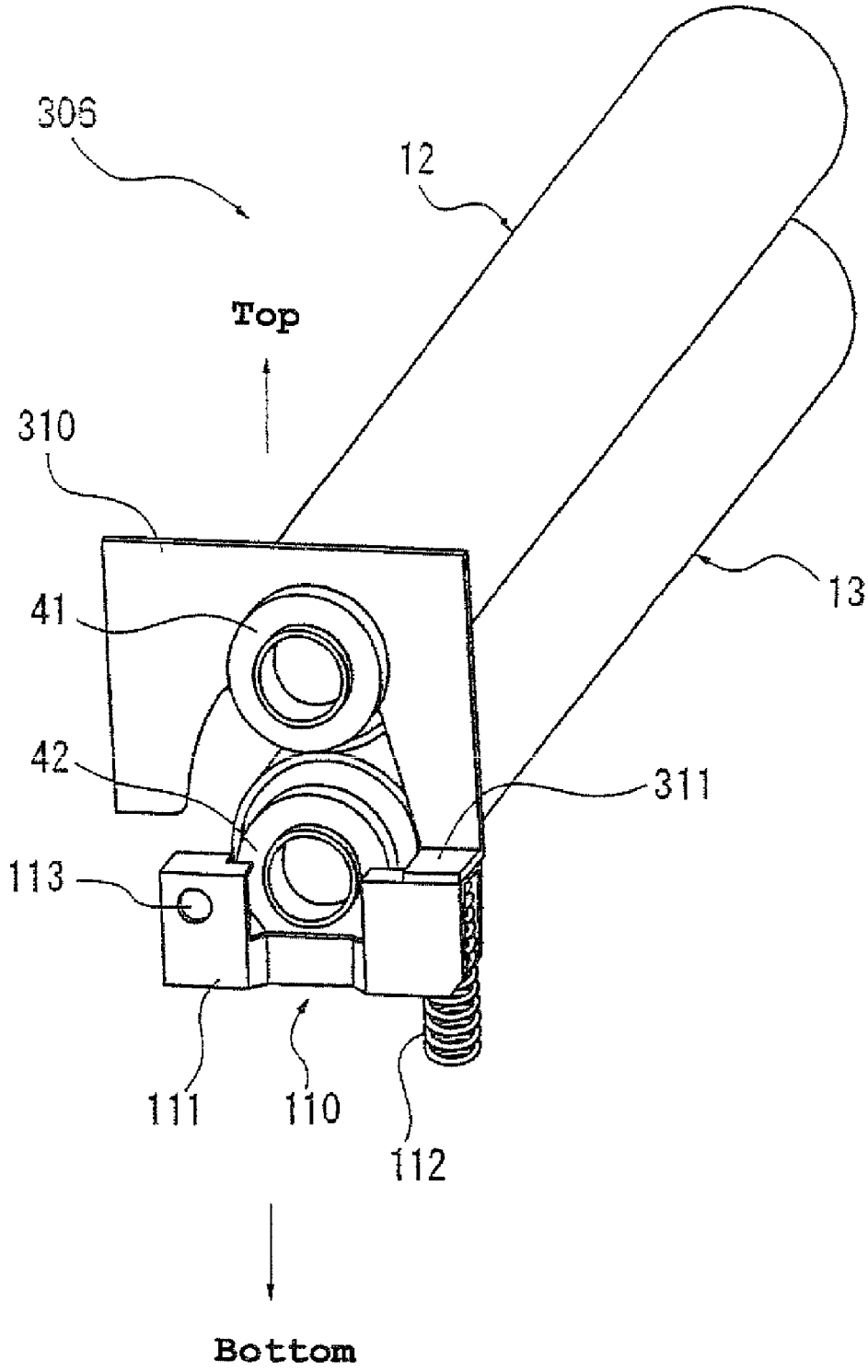
FIG. 9 is a perspective view showing the configuration of a third exemplary embodiment of a fusing unit according to the present embodiment; and, FIG. 10 is an illustrative view showing the configuration of a fusing unit of the third exemplary embodiment, viewed from the direction of the roller axis.
Figure 10:
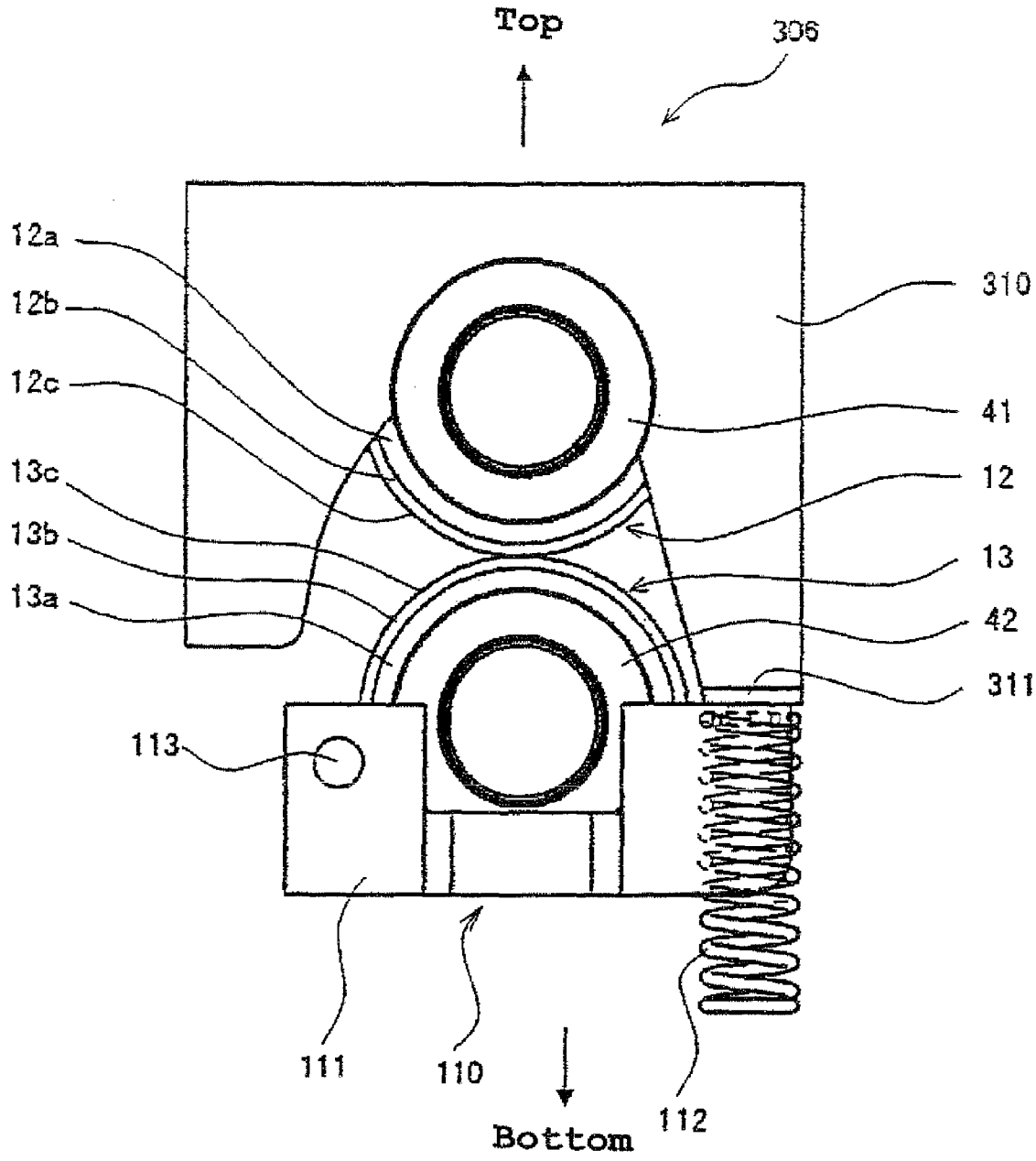

FIG. 9 is a perspective view showing the configuration of the third exemplary embodiment of a fusing unit according to the present embodiment, and FIG. 10 is an illustrative view showing the configuration of the fusing unit, viewed from the direction of the roller axis.

Here in the third exemplary embodiment, the same components as those in the first and second exemplary embodiments are allotted with the same reference numerals, so that their description is omitted.

As shown in FIGS. 9 and 10, a fusing unit (fusing device) 306 of the third exemplary embodiment includes a pressing structure 110 for arranging rotatable fusing roller 12 and pressing roller 13 so as to oppose each other and put pressing roller 13 into press-contact with fusing roller 12, and a fusing roller side frame (frame structure) 310 for regulating the pressing action of pressing structure 110.

Here, in the third exemplary embodiment, the difference from the configurations of the first and second exemplary embodiments will be described.

Fusing roller side frame 310 holds fusing roller 12 relative to the axis of pressing roller and has a pressing lever positioning portion (pressing structure regulator) 311 for regulating the movement of pressing lever 111. In this exemplary embodiment, pressing lever positioning portion 311 is formed by bending one end part of fusing roller side frame 310.

Pressing lever positioning portion 311 is arranged at a position opposing the opposite end of pressing lever 111 from the supporting shaft 113 side so as to prevent pressing lever 111 from urging pressing roller 13 toward fusing roller 12 side when pressing roller 13 is positioned in place with respect to fusing roller 12.

Specifically, as shown in FIG. 10, when pressing lever 111 abuts pressing lever positioning portion 311, pressing roller 13 has been pressed upward by pressing lever 111 under the pressure of pressing spring 112 so as to abut fusing roller 12 at a predetermined position, thus creating the condition in which pressing roller 13 and fusing roller 12 are kept in press-contact with each other by the predetermined pressing force from pressing spring 112.

With this configuration, even if pressing roller 13 has been urged under pressure against fusing roller 12 for many hours when the apparatus has been set in the ready state, deactivated or the like, it is possible to alleviate the pressing force from pressing spring 112 by abutting pressing lever 111 against pressing lever positioning portion 311. Accordingly, it is possible to prevent part of elastic layers 12*b* and 13*b* of fusing roller 12 and pressing roller 13 from being deformed permanently.

As described above, since the pressing action of pressing lever 111 is limited by pressing lever positioning portion 311 so as to regulate the amount of pressing roller 13 being pressed against fusing roller 12 and hence alleviate the urging force from pressing spring 112, it becomes difficult to assure the nip width necessary for fusing toner images. To deal with this, also in the third exemplary embodiment, in consideration of the thermal expansion of elastic layers 12*b* and 13*b* and releasing layers 12*c* and 13*c*, the layout of pressing lever positioning portion 311 is designated so that the nip width W1 between fusing roller 12 and pressing roller 13, required at the time of toner fusing (fusing temperature: 180 deg. C.) is 4.5 mm and that the nip width W2 between fusing roller 12 and pressing roller 13 at normal temperature (25 deg. C.) is 4.0 mm. With this setup, partial permanent deformation in elastic layers 12*b* and 13*b* of fusing roller 12 and pressing roller 13 in the normal state can be prevented from occurring.

According to the third exemplary embodiment thus constructed, since the pressing action of pressing lever 111 is regulated by pressing lever positioning portion 311 provided for fusing roller side frame 310, it is possible to prevent a pressing force greater than needed, from being applied on fusing roller 12. As a result, it is possible to prevent occurrence of partial permanent deformation in elastic layers 12*b* and 13*b* of fusing roller 12 and pressing roller 13.

As described above, according to the embodiment and exemplary embodiment, since in fusing units 6, 106, 206 and 306, pressure release lever 120, positioning pin 211 or pressing lever positioning portion 311 is provided in order to regulate the pressing action of pressing structure 110 for placing pressing roller 13 into press-contact with fusing roller 12, it is hence possible to reduce the pressing force imparted by pressing spring 112 when the apparatus is deactivated or in the ready state and prevent occurrence of partial permanent deformation in elastic layers 12*b* and 13*b* of fusing roller 12 and pressing roller 13.

Further, in the above-described examples, the particular constituents, such as the outside diameters of fusing roller 12 and pressing roller 13, the thicknesses of elastic layers 12*b*, 13*b* and releasing layers 12*c*, 13*c*, were specified numerically. However, since the conditions under which permanent deformation occurs will vary depending on the hardness and thickness of the elastic layers, and also since the nip width necessary for toner fusing will vary depending on the speed of paper conveyance etc., the technology should not be limited to the above examples, and the above factors can be designated as appropriate at the optimal numeric values.

As described heretofore, application of the fusing unit to image forming apparatus 1 makes it possible to prevent occurrence of partial permanent deformation in elastic layers 12*b* and 13*b* of fusing roller 12 and pressing roller 13, it is hence possible to achieve a stable fusing operation. As a result, it is possible to stably perform high-quality image printing with toner images reliably fused and fixed.

Having described the preferred embodiment modes, it goes without saying that the technology should not be limited to the above-described examples, and it is obvious that various changes and modifications will occur to those skilled in the art within the scope of the appended claims. Such variations are therefore understood to be within the technical scope of the technology.

For example, in the above embodiment, the technology is applied to a monochrome image forming apparatus, but the technology can also be applied to a color image forming apparatus including a fusing device that fuses and fixes a toner image to a recording medium.

What is claimed is:

1. A fusing device for an image forming apparatus, comprising:

a pair of roller members functioning as a fusing roller and a pressing roller, at least one of the roller members having an elastic layer on the peripheral surface thereof;

a pressing structure for bringing the roller members into press-contact with each other such that when a recording medium with an unfixed toner image formed thereon passes through the press-contact portion, the toner image is fused and fixed to the recording medium; and a pressing structure regulator for regulating the pressing action of the pressing structure when the roller members are put into contact with each other by the pressing structure, the pressing structure regulator comprising a stationary element fixed to a frame of the fusing device, the stationary element limiting movement of a first one of the rollers members toward the second roller member.

2. The fusing device according to claim 1, wherein the pressing structure regulator is constituted by part of a frame structure of the fusing device for supporting one of the paired roller members, and regulates the pressing action of the pressing structure when the pressing structure is abutted to the part of the frame structure.

3. The fusing device according to claim 1, wherein the pressing structure regulator includes a pressure release member for releasing the press-contact state between the rollers by the pressing structure and a pressure release member regulator for regulating the movement of the pressure release member, and the pressing action of the pressing structure is regulated by putting the pressure release member and the pressure release member regulator into contact with each other under the condition where the pressing structure and the pressure release member are in contact when the roller members are put into contact with each other by the pressing structure.

4. The fusing device according to claim 1, wherein with the roller members put in press-contact with each other by the pressing structure, the pressing structure regulator is adapted to create a necessary nip width for fusing toner images, by thermal expansion of the roller members when a fusing operation for fusing and fixing toner images to recording mediums is activated.

5. An image forming apparatus including a fusing device specified in claim 1.

6. The fusing device according to claim 1, wherein the stationary element is fixed to a non-moving portion of a frame of the fusing device.

7. The fusing device according to claim 1, wherein the pressing structure comprises:

a movable support frame upon which a first one of the roller members is mounted; and at least one biasing member that biases the movable support frame in a direction that brings the first roller member into press-contact with the second roller member, and wherein the stationary element limits movement of the movable support frame toward the second roller member.

8. The fusing device according to claim 7, wherein the stationary element is fixed to a non-moving portion of a frame of the fusing device.

9. The fusing device according to claim 8, wherein the stationary element is a pin that extends from a non-moving portion of the frame of the fusing device, and wherein the pin is located such that it blocks movement of the movable support frame after the movable support frame has put the first roller member into press-contact with the second roller member.

10. A fusing device for an image forming apparatus, comprising:

a stationary frame;

a pair of roller members that are rotationally mounted on the frame and that function as a fusing roller and a pressing roller, wherein at least one of the roller members has an elastic layer on the peripheral surface thereof, and wherein a first one of the roller members can move into and out of press-contact engagement with the second roller member;

a pressing frame that is movably mounted on the stationary frame and that presses the first roller member into press-contact engagement with the second roller member;

at least one biasing member that biases the pressing frame in a direction that brings the first roller member into press-contact with the second roller member;

a pressure release lever mounted on the frame and that is movable between a first position and a second position, wherein when the pressure release lever is in the first position, the movable support frame can move to a position at which the first roller member is brought into press-contact with the second roller member, and wherein when the pressure release lever is in the second position, the pressure release lever holds the movable support frame in a position which results in the first roller member coming out of press-contact with the second roller member; and a pressing structure regulator that includes a stationary element fixed to a non-moving portion of the stationary frame, wherein the stationary element holds the pressure release lever in the first position.

11. The fusing device according to claim 10, wherein the stationary element limits pivotal movement of the pressure release lever.

12. The fusing device according to claim 11, wherein the stationary element and the pressure release lever act together to limit movement of the pressing frame in a direction that brings the first roller member into press-contact with the second roller member.

13. An image forming apparatus comprising the fusing device of claim 10.

* * * * *